US008826594B2

(12) United States Patent
Graves

(10) Patent No.: US 8,826,594 B2
(45) Date of Patent: Sep. 9, 2014

(54) PET DOOR WITH LOCKING FLAPS

(71) Applicant: Radio Systems Corporation, Knoxville, TN (US)

(72) Inventor: Jason R. Graves, Knoxville, TN (US)

(73) Assignee: Radio Systems Corporation, Knoxville, TN (US)

( * ) Notice: Subject to any disclaimer, the term of this patent is extended or adjusted under 35 U.S.C. 154(b) by 0 days.

(21) Appl. No.: 13/894,163

(22) Filed: May 14, 2013

(65) Prior Publication Data

US 2013/0305609 A1 Nov. 21, 2013

Related U.S. Application Data

(60) Provisional application No. 61/647,465, filed on May 15, 2012.

(51) Int. Cl.
*E06B 7/28* (2006.01)

(52) U.S. Cl.
USPC ..... 49/169

(58) Field of Classification Search
USPC ..... 49/163, 169; 160/180, 90, 369; 119/481–485, 501
See application file for complete search history.

(56) References Cited

U.S. PATENT DOCUMENTS

| | | | | |
|---|---|---|---|---|
| 2,758,646 | A * | 8/1956 | Johnson | 160/354 |
| 4,022,263 | A * | 5/1977 | Beckett et al. | 160/92 |
| 4,776,133 | A * | 10/1988 | Green | 49/394 |
| 4,840,217 | A * | 6/1989 | Evans, III | 160/368.1 |
| 4,991,350 | A * | 2/1991 | Kirk | 49/169 |
| 5,406,748 | A * | 4/1995 | Davlantes | 49/169 |
| 5,701,702 | A * | 12/1997 | Reid et al. | 49/169 |
| 5,992,096 | A * | 11/1999 | De La Cerda et al. | 49/169 |
| 6,385,909 | B1 * | 5/2002 | Marsh et al. | 49/169 |
| 6,681,524 | B1 * | 1/2004 | Tillson | 49/169 |
| 6,959,511 | B2 * | 11/2005 | Johnson et al. | 49/169 |
| 7,120,967 | B2 * | 10/2006 | Johnson | 16/275 |
| 7,564,362 | B2 * | 7/2009 | Cole et al. | 340/573.1 |
| 7,583,931 | B2 * | 9/2009 | Eu | 455/41.2 |
| 7,765,955 | B2 * | 8/2010 | Brooks et al. | 119/484 |

(Continued)

FOREIGN PATENT DOCUMENTS

GB 2430694 B 4/2010

OTHER PUBLICATIONS

International Search Report and Written Opinion for PCT/US2013/041091 mailed Sep. 12, 2013.

*Primary Examiner* — Jerry Redman
(74) *Attorney, Agent, or Firm* — J. Kenneth Hoffmeister; Merchant & Gould

(57) ABSTRACT

A pet door with locking flaps, or lockable pet door. The lockable pet door includes a barrier flap surrounded by one or more locking flaps mounted in the pet door frame. The locking flaps, the barrier flap, and the pet door frame cooperate to provide selective direction control allowing ingress, egress, both, or neither. Each locking flap is independently and selectively attached to the frame of the pet door to prevent movement of the locking flap. Each locking flap defines a through opening. In use, the animal passes through the locking flap on the entry side of the pet door and the locking flap on the exit side moves with the barrier flap. When locked, each locking flap prevents the barrier flap from pivoting to that side of the pet door blocking passage in that direction.

20 Claims, 15 Drawing Sheets

(56) References Cited

U.S. PATENT DOCUMENTS

| | | | | |
|---|---|---|---|---|
| 7,913,454 | B2 * | 3/2011 | Sullivan | 49/169 |
| 8,240,085 | B2 * | 8/2012 | Hill | 49/169 |
| 8,333,037 | B2 * | 12/2012 | Sullivan | 49/169 |
| 8,539,715 | B2 * | 9/2013 | Hill | 49/169 |
| 2007/0175097 | A1 * | 8/2007 | Thorne et al. | 49/169 |
| 2007/0234643 | A1 * | 10/2007 | Siegal et al. | 49/360 |
| 2008/0184940 | A1 | 8/2008 | Bosserdet et al. | |
| 2009/0260294 | A1 | 10/2009 | Sullivan | |

* cited by examiner

PET DOOR WITH LOCKING FLAPS

BACKGROUND

Many households have pets, and many pet owners have the need to give their pet free access to the outdoors so that the pet may eliminate outside or enjoy being outdoors without the pet owner present. One limitation of many electronic pet doors is the inability to independently control ingress and egress, in general, and on a per pet basis. As a result, when unlocked by an authorized pet, the pet door makes it possible for an unauthorized pet on the opposite side of the pet door to use the pet door. Another limitation of existing pet doors is the strength and security of the locks. Some pets or animals are capable of forcing their way through the flap and defeating the lock. Another area of concern with existing pet doors is the effectiveness of the weather seal. It is with respect to these and other considerations that the present invention has been made.

BRIEF SUMMARY

Embodiments of the present invention may provide a lockable pet door including a barrier flap surrounded by one or more locking flaps mounted in the pet door frame. The locking flaps, the barrier flap, and the pet door frame cooperate to provide selective direction control allowing ingress, egress, both, or neither. Each locking flap is independently and selectively attached to the frame of the pet door to prevent movement of the locking flap. Each locking flap defines a through opening. In use, the animal passes through the locking flap on the entry side of the pet door and the locking flap on the exit side moves with the barrier flap. When locked, each locking flap prevents the barrier flap from pivoting to that side of the pet door blocking passage in that direction.

The lockable pet door includes an interior frame that carries a barrier flap and one or more locking flaps. The barrier flap opens and closes to selectively permit passage in both directions through the lockable pet door. The locking flaps serve to selectively prevent the barrier flap from opening in one or both directions when engaged. In various embodiments, the lockable pet door includes an inner locking flap mounted in the lockable pet door on the interior side of the barrier flap and an outer locking flap mounted in the lockable pet door on the exterior side of the barrier flap. In other embodiments, the lockable pet door includes only an inner locking flap or an outer locking flap.

The interior frame defines a through opening (i.e., the primary opening) that serves as an interior opening to a passageway through the structural feature. In various embodiments, at least a portion of the interior frame bounding the primary opening serves as a locking flap stop to limit the travel of the locking flaps. The interior frame also includes one or more coupling members located proximate to the perimeter of the primary opening to selectively engage the locking flaps. Each locking flap is a substantially rigid member defining a through opening (i.e., a secondary opening). The locking flap is designed such that the barrier flap does not pass through the secondary opening.

Both the barrier flap and the locking flaps move relative to the interior frame. The barrier flap is mounted in the lockable pet door such that it can swing both inwardly and outwardly. Normally, the barrier flap remains in a closed position where it hangs in a substantially vertical orientation and blocks passage through the lockable pet door. The locking flap is mounted in the lockable pet door on one side of the barrier flap such that it may swing away from the barrier flap. Like the barrier flap, the locking flap normally remains in the closed position where it hangs in a substantially vertical orientation proximate to the barrier flap. When the locking flap is in the closed position, the secondary opening is axially aligned with the primary opening. The barrier flap is moveable over a range from a fully open inward position to a fully open outward position. The locking flap is moveable over a range from the closed position to a fully open position. When unlocked, the locking flap travels with the barrier flap.

In various embodiments, locking and unlocking the lockable pet door is accomplished by changing the relative position of the locking flap to the interior frame. In some embodiments, the locking flap moves in a lateral direction between a locked position and an unlocked position. In some embodiments, the locking flap moves in a vertical direction between a locked position and an unlocked position. In other embodiments, locking and unlocking the lockable pet door is accomplished by fixing the position of locking flap relative to the interior frame without additional movement of the locking flap or the interior frame.

Like the interior frame, the locking flap includes one or more coupling members positioned to selectively engage the complimentary coupling member of the inner frame. In various embodiments, the coupling members of the interior frame and the locking flaps are fasteners brought into engagement by the movement of the locking flap relative to interior. In other embodiments, the coupling members are placed into engagement without requiring movement of the locking flap relative to interior frame. When in the locked position, the locking flap is prevented from swinging toward the fully open position (i.e., opening). By preventing the locking flap from opening, the barrier flap is also prevented from swinging toward the fully open position in the direction of the locked locking flap.

BRIEF DESCRIPTION OF THE DRAWINGS

Further features, aspects, and advantages of the invention represented by the embodiments described present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

A pet door with locking flaps, or lockable pet door, is described herein and illustrated in the accompanying figures. The lockable pet door includes a barrier flap surrounded by one or more locking flaps mounted in the pet door frame. The locking flaps, the barrier flap, and the pet door frame cooperate to provide selective direction control allowing ingress, egress, both, or neither. Each locking flap is independently and selectively attached to the frame of the pet door to prevent movement of the locking flap. Each locking flap defines a through opening. In use, the animal passes through the locking flap on the entry side of the pet door and the locking flap on the exit side moves with the barrier flap. When locked, each locking flap prevents the barrier flap from pivoting to that side of the pet door blocking passage in that direction.

As used herein, terms of direction (e.g., front, rear, up, down, top, bottom, inner, outer, horizontal, vertical, inwardly, outwardly, interior, exterior, etc.) are used to provide a frame of reference for purposes of discussion and are not intended to limit any feature of the lockable pet door to a single direction or orientation.

Figure 1A:
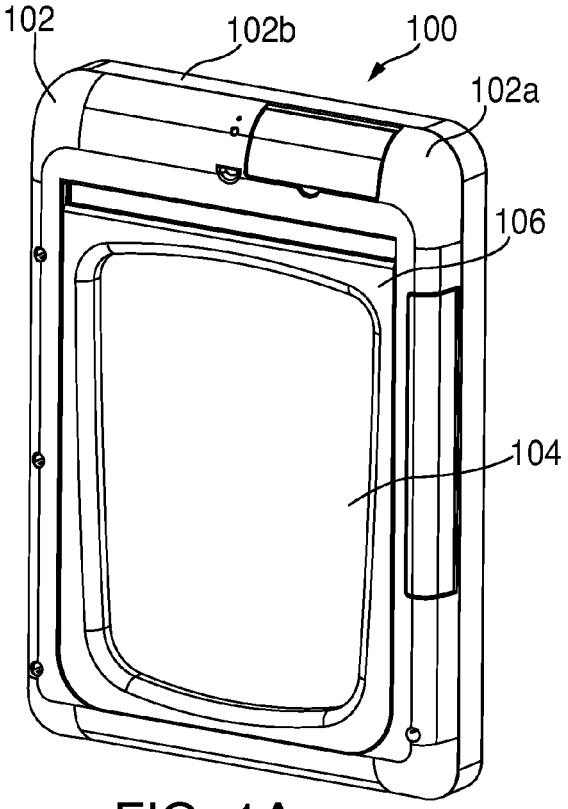
FIG. 1A is a front perspective view of the interior frame assembly of one embodiment of the lockable pet door.

FIG. 1A is a front perspective view of one embodiment of the lockable pet door 100. The lockable pet door includes an interior frame 102 that carries a barrier flap 104 and one or more locking flaps 106. The interior frame serves as the main frame of the lockable pet door 100. The barrier flap 104 opens and closes to selectively permit passage in both directions through the lockable pet door. When engaged, the locking flaps 106 serve to selectively prevent the barrier flap 104 from opening in one or both directions. In various embodiments, the lockable pet door includes an inner locking flap 106*a* mounted on the interior side of the barrier flap 104 and an outer locking flap 106*b* mounted on the exterior side of the barrier (i.e., center) flap 104. In other embodiments, the lockable pet door includes only an inner locking flap or an outer locking flap. The interior frame 102 is intended to be mounted on the interior of the structural feature (e.g., door or wall). In various embodiments, the interior frame 102 includes a front part 102*a* and a back part 102*b*.

Figure 1B:
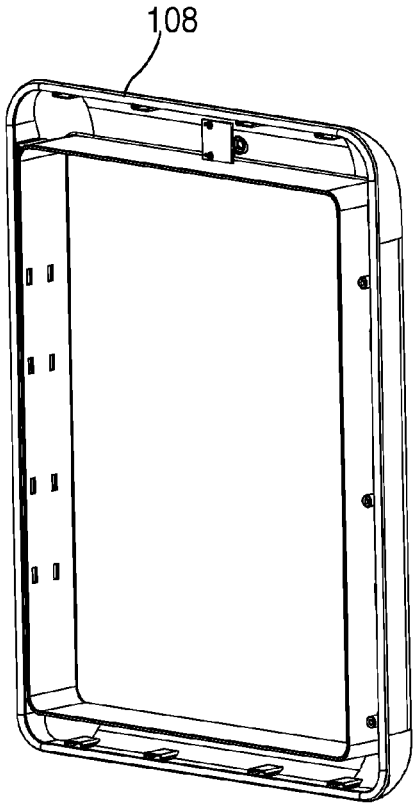
FIG. 1B is a rear perspective view of the exterior frame of one embodiment of the lockable pet door

FIG. 1B is a rear perspective view of an exterior frame usable with one embodiment of the lockable pet door. The exterior frame 108 is intended to be mounted on the exterior of the structural feature and connected to the interior frame 102. As the mounting hardware is tightened, the interior frame 102 and the exterior frame 108 are clamped against the structural feature.

Figure 2:
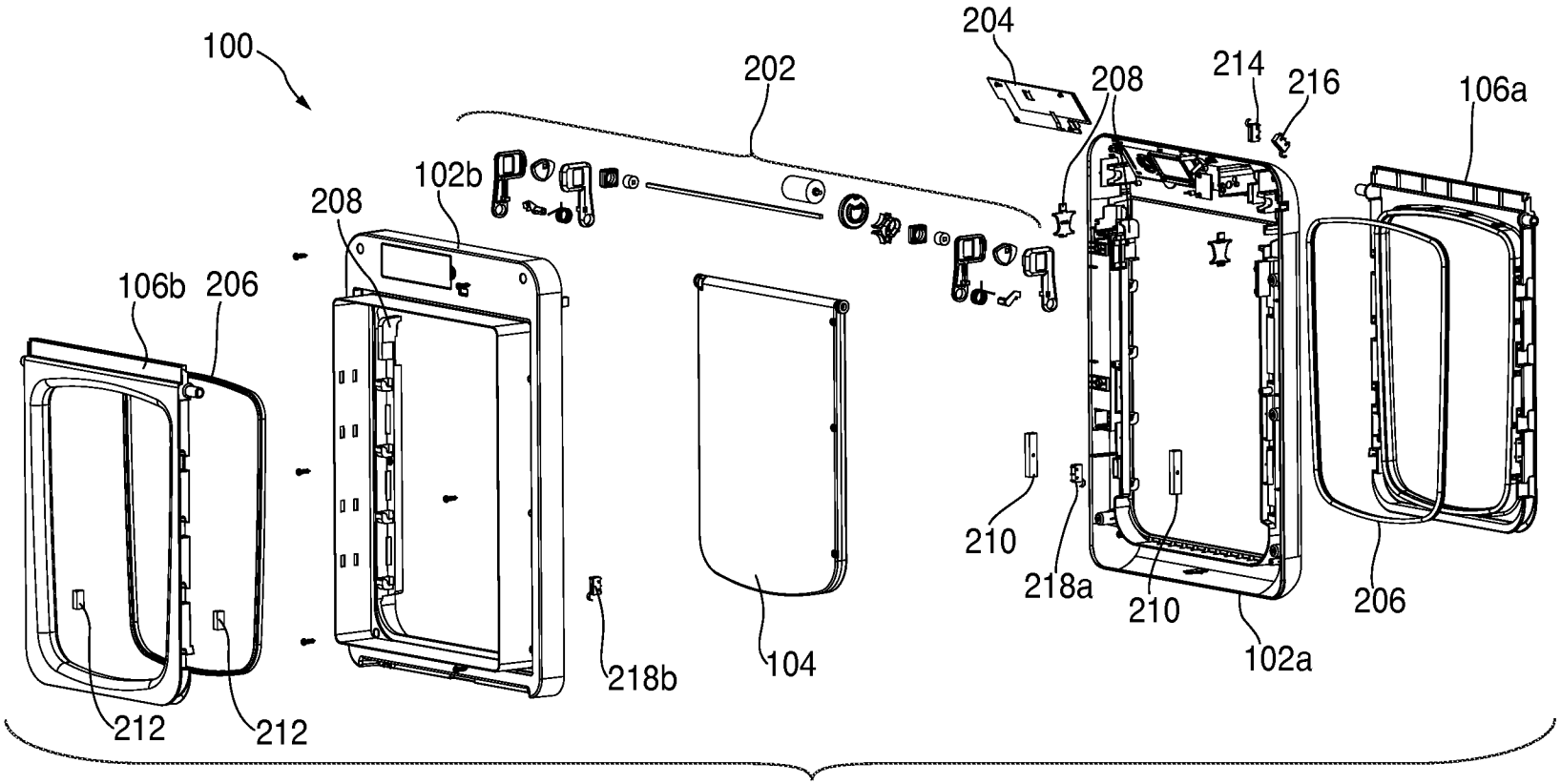
FIG. 2 is an exploded perspective view of one embodiment of the lockable pet door.
Figure 3:
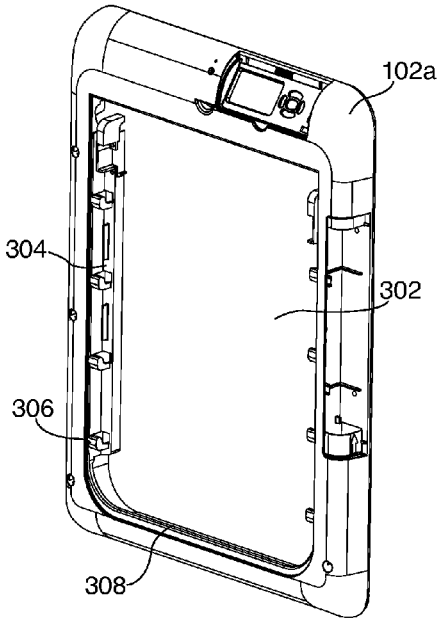
FIG. 3 is a front perspective view of the front part of one embodiment of the interior frame.
Figure 4:
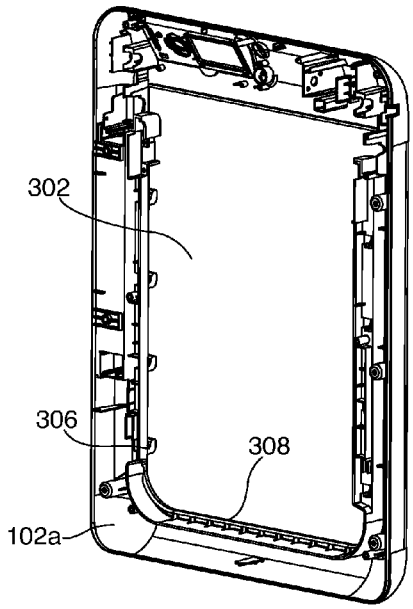
FIG. 4 is a rear perspective view of the front part of one embodiment of the interior frame.
Figure 5:
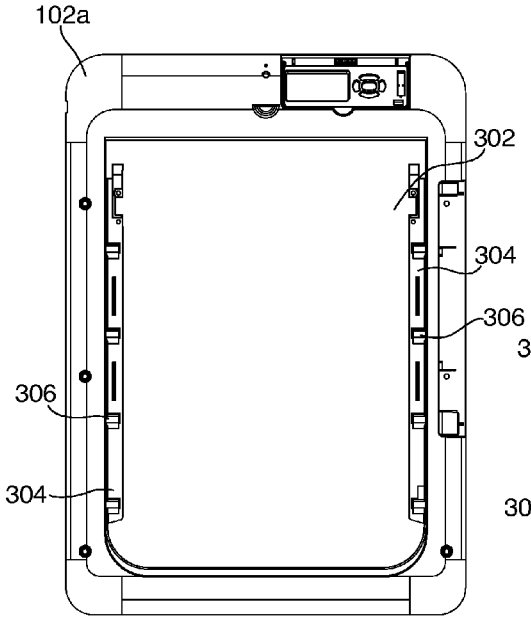
FIG. 5 is a front elevation view of the front part of one embodiment of the interior frame.
Figure 6:
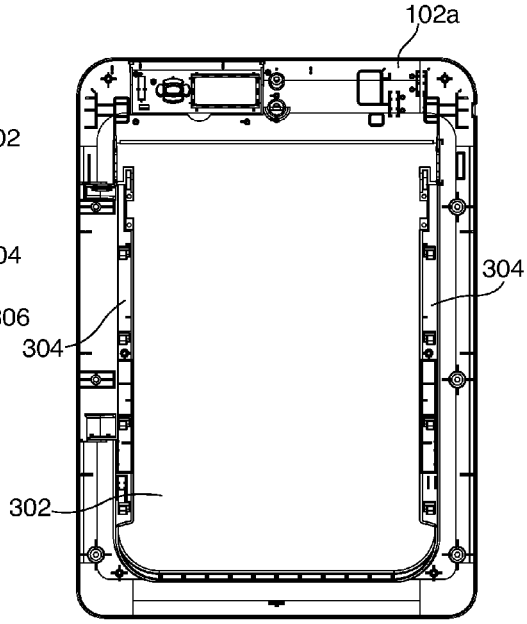
FIG. 6 is a rear elevation view of the front part of one embodiment of the interior frame.
Figure 7:
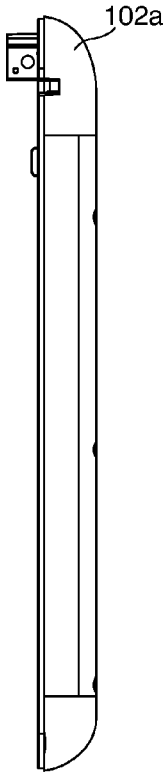
FIG. 7 is a left side elevation view of the front part of one embodiment of the interior frame.
Figure 8:
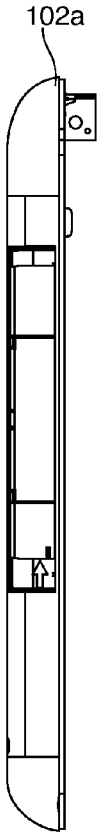
FIG. 8 is a right side elevation view of the front part of one embodiment of the interior frame.
Figure 9:
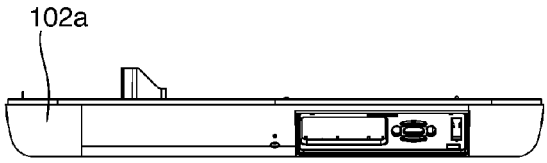
FIG. 9 is a top plan view of the front part of one embodiment of the interior frame.
Figure 10:
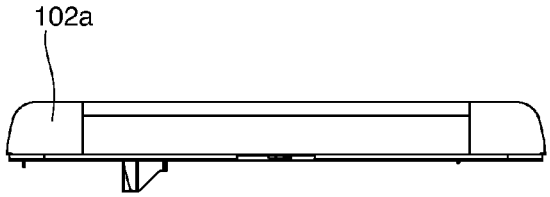
FIG. 10 is a bottom plan view of the front part of one embodiment of the interior frame.
Figure 11:
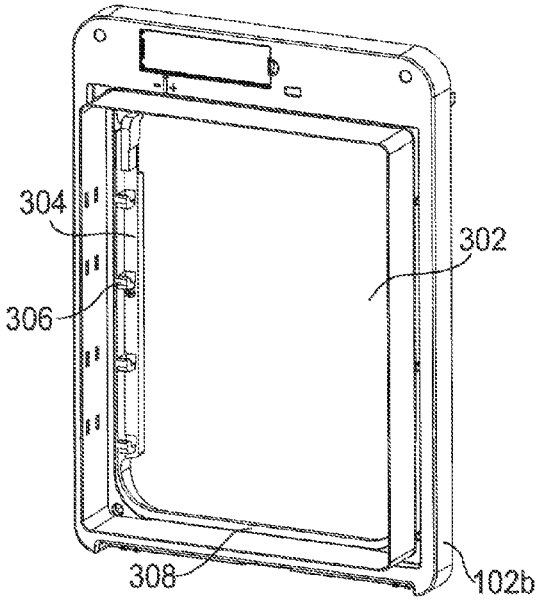
FIG. 11 is a front perspective view of the rear part of one embodiment of the interior frame.
Figure 12:
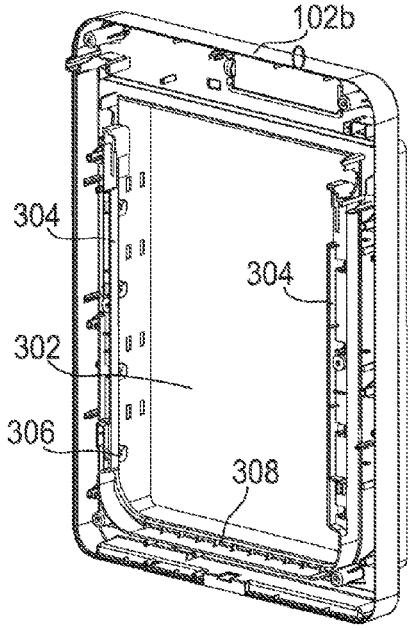
FIG. 12 is a rear perspective view of the rear part of one embodiment of the interior frame.
Figure 13:
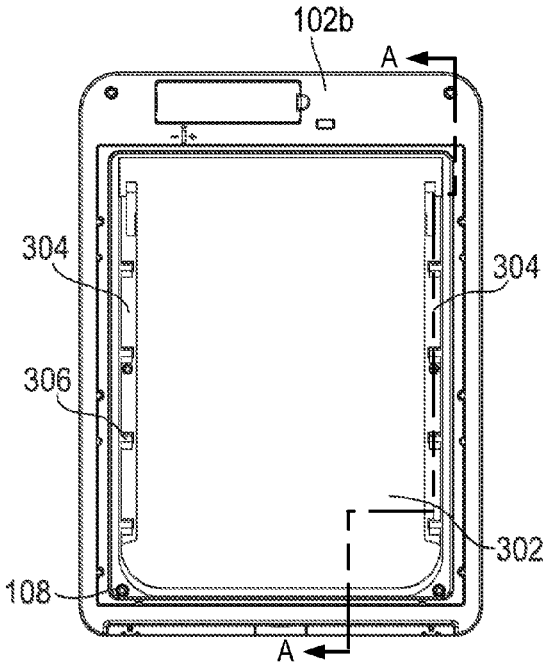
FIG. 13 is a front elevation view of the rear part of one embodiment of the interior frame.
Figure 14:
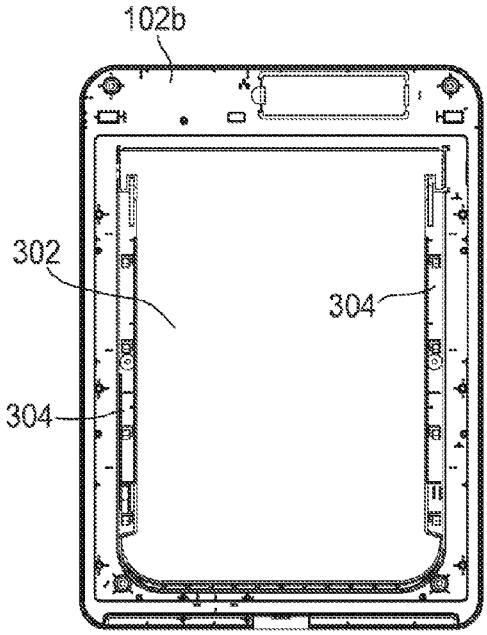
FIG. 14 is a rear elevation view of the rear part of one embodiment of the interior frame.
Figure 15:
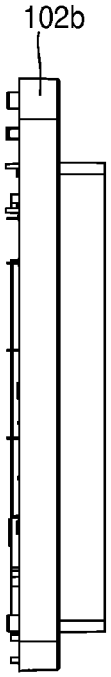
FIG. 15 is a left side elevation view of the rear part of one embodiment of the interior frame.
Figure 16:
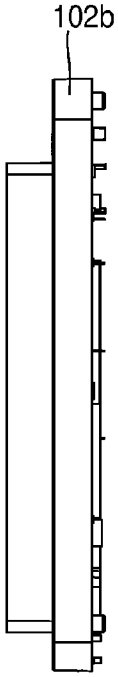
FIG. 16 is a right side elevation view of the rear part of one embodiment of the interior frame.
Figure 17:
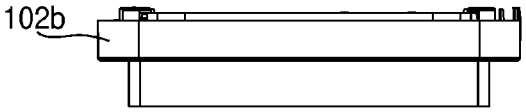
FIG. 17 is a top plan view of the rear part of one embodiment of the interior frame.
Figure 18:
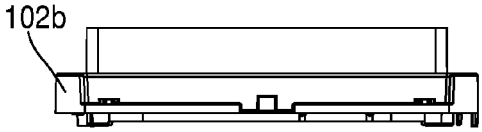
FIG. 18 is a bottom plan view of the rear part of one embodiment of the interior frame.

FIG. 2 is an exploded view of one embodiment of the lockable pet door. In various embodiments, the interior frame serves as a housing to contain the lock mechanism 202 and other mechanical, electromechanical, and/or electronic components. In some embodiments, the controls 204 for the lockable pet door (e.g., the controls for lock mechanism) are carried by the interior frame 102 and accessible to the operator.

FIGS. 3 through 10 illustrate various views of the front part of one embodiment of the interior frame 102. FIGS. 11 through 18 illustrate various views of the rear portion of the one embodiment of the interior frame 102. While some embodiments of the interior frame 102 are fabricated in multiple parts, the features of the interior frame 102 are generally not specific to any particular part. In other embodiments, the interior frame 102 is single part. Accordingly, the features of the interior frame 102 are discussed collectively in reference to the interior frame 102 although the front and rear portions are illustrated separately.

The interior frame defines a through opening 302 (i.e., the primary opening) that serves as an interior opening to the passageway through the structural feature. In various embodiments, at least a portion of the interior frame 102 bounding the primary opening 302 serves as a locking flap stop 304 to limit the travel of the locking flaps 106. In some embodiments, the locking flap stop 304 includes one or more projections into the primary opening 302. In other embodiments, the locking flap stop 304 is a shoulder or flange around at least a portion of the primary opening 302. In some embodiments, the inner and outer locking flaps 106 engage a common locking flap stop 304. In other embodiments, the interior frame 102 includes one locking flap stop 304*a* for the inner locking flap 106*a* and a separate locking flap stop 304*b* for the outer locking flap 106*b*.

The interior frame also includes one or more coupling members 306 located proximate to the perimeter of the primary opening 302 to selectively engage the locking flaps 106. In various embodiments, the interior frame 102 includes a set of inner coupling members 306*a* to engage the inner locking flap 106*a* and a set of outer coupling members 306*b* to engage the outer locking flap 106*b*. In various embodiments, the coupling members 306 are located on the locking flap stops 304. In some embodiments, the coupling members 306 are located on the opposing faces of the locking flap stops 304.

Figure 19:
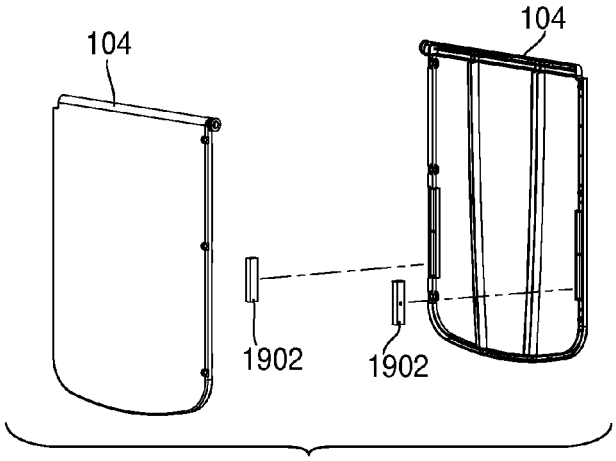
FIG. 19 is an exploded view of the barrier flap.
Figure 20:
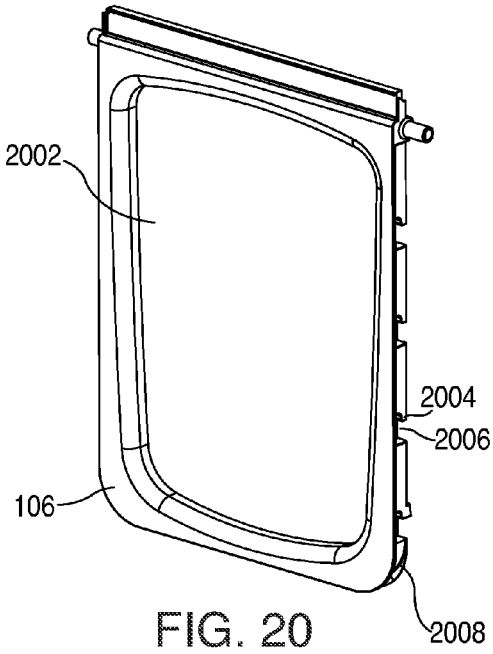
FIG. 20 is a front perspective view of one embodiment of the locking flap.
Figure 21:
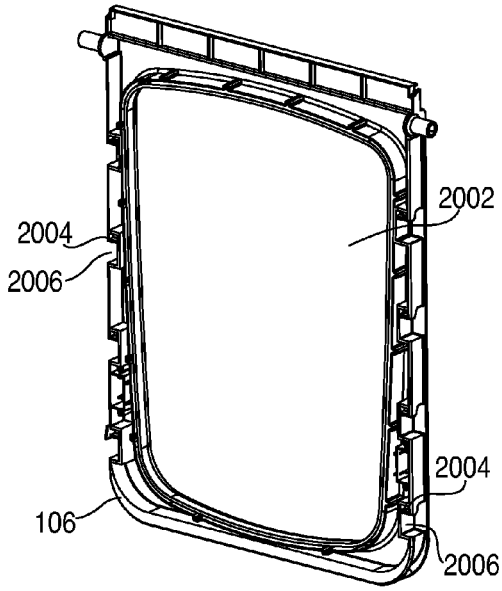
FIG. 21 is a rear perspective view of one embodiment of the locking flap.
Figure 22:
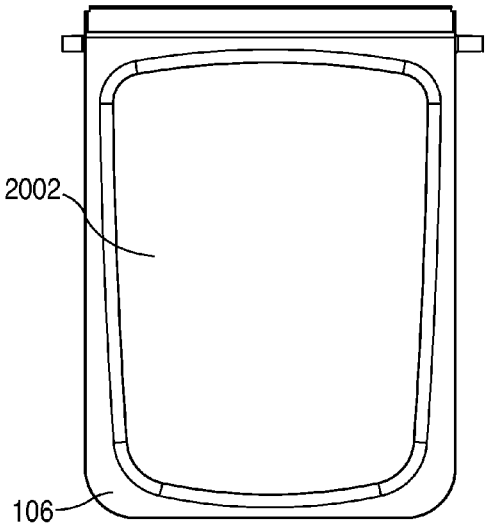
FIG. 22 is a front elevation view of one embodiment of the locking flap.
Figure 23:
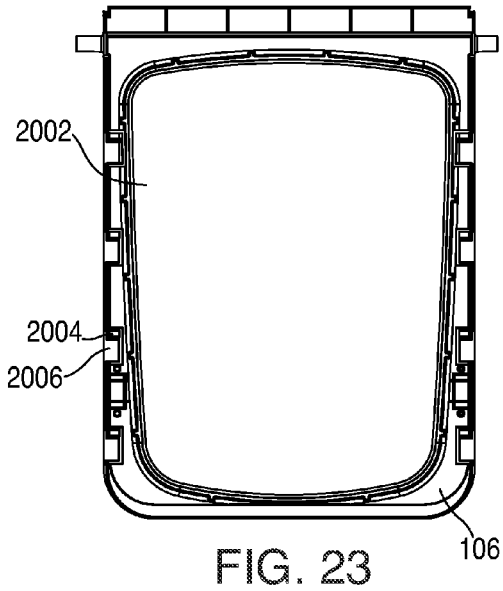
FIG. 23 is a rear elevation view of one embodiment of the locking flap.
Figure 24:
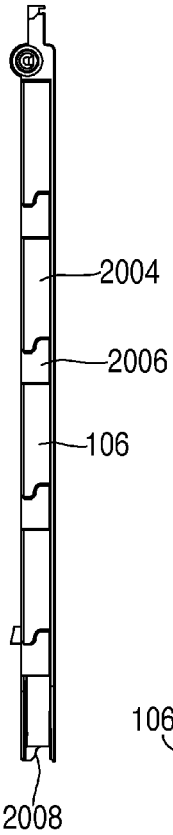
FIG. 24 is a left side elevation view of one embodiment of the locking flap.
Figure 25:
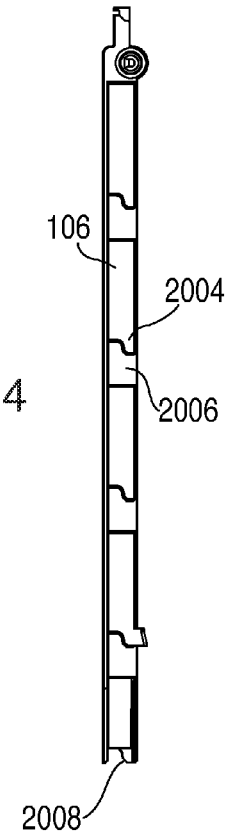
FIG. 25 is a right side elevation view of one embodiment of the locking flap.
Figure 26:
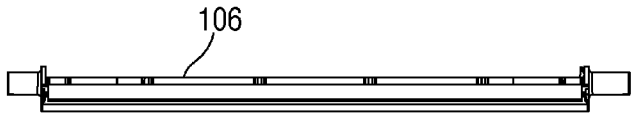
FIG. 26 is a top plan view of one embodiment of the locking flap.
Figure 27:
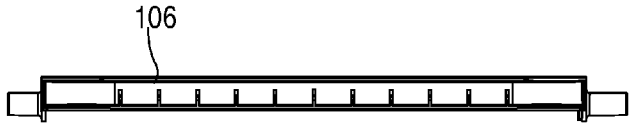
FIG. 27 is a bottom plan view of one embodiment of the locking flap.

FIG. 19 is an exploded view of one embodiment of the barrier flap 104. Generally, the barrier flap 104 substantially conforms to the shape and dimensions of the primary opening 302. More specifically, the barrier flap 104 is dimensioned to fit within the inner perimeter of the interior frame 102 and fill the primary opening 302. In other words, the barrier flap 104 does not engage and is not hindered by the locking flap stops 306. In some embodiments, the entire barrier flap 104 is rigid. In other embodiments, some portion of the barrier flap 104 is not rigid but is supported by a rigid portion (e.g., a frame).

FIGS. 20 through 27 illustrate various views of the one embodiment of the locking flap 106. The locking flap 106 is a substantially rigid member defining a through opening 2002 (i.e., a secondary opening). Generally, the outer perimeter of the locking flap 106 conforms to the shape and dimensions of the primary opening 302. The locking flap 106 is configured such that the barrier flap 104 does not pass through the secondary opening 2002. In various embodiments, the inner perimeter of the locking flap 106 (i.e., the secondary opening 2002) is smaller than the outer perimeter of the barrier flap 104.

In various embodiments, the locking flap 106 offers improved weather resistance and insulation for the lockable pet door. In some embodiments, the locking flap 106 engages the barrier flap 104 forming a seal. In some embodiments, the lockable pet door includes a sealing gasket 206 between the locking flap 106 and the barrier flap 104. In some embodiments, the sealing gasket 206 is compressible. In some embodiments, the sealing gasket 206 covers the gap between the barrier flap 104 and the interior frame 102.

Both the barrier flap 104 and the locking flaps 106 move relative to the interior frame 102. The barrier flap 104 is mounted in the lockable pet door such that it can swing both inwardly and outwardly. Normally, the barrier flap 104 remains in a closed position where it hangs in a substantially vertical orientation and blocks passage through the lockable pet door. The locking flap 106 is mounted in the lockable pet door on one side of the barrier flap 104 such that it may swing away from the barrier flap 104. More specifically, the locking flap stop 304 is configured to engage the locking flap 106 and prevent it from rotating past the closed position. In other words, the locking flap 106 swings with the barrier flap 104 in one direction. The locking flap 106 normally remains in the closed position where it hangs in a substantially vertical orientation proximate to the barrier flap 104. When the locking flap 106 is in the closed position, the secondary opening 2002 is axially aligned with the primary opening 302.

Figure 28:
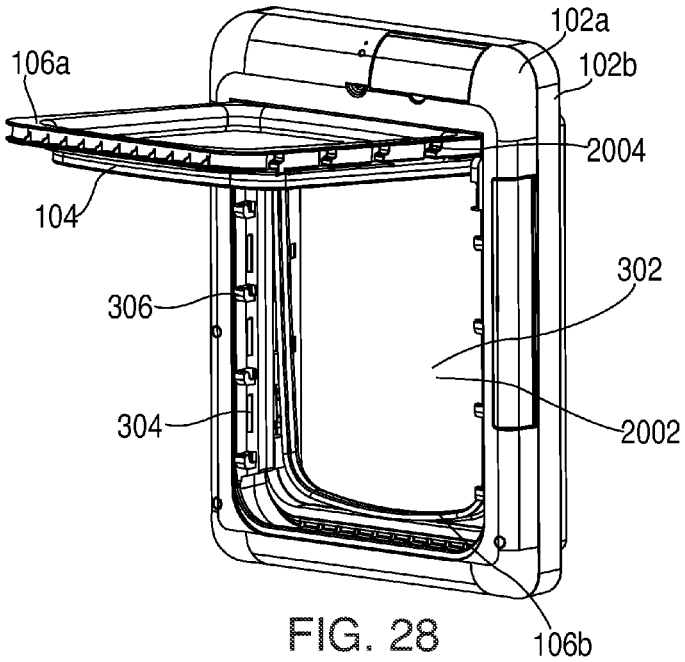
FIG. 28 is a front perspective view of the interior frame showing the barrier flap and the inner locking flap in the inward fully open position.
Figure 29:
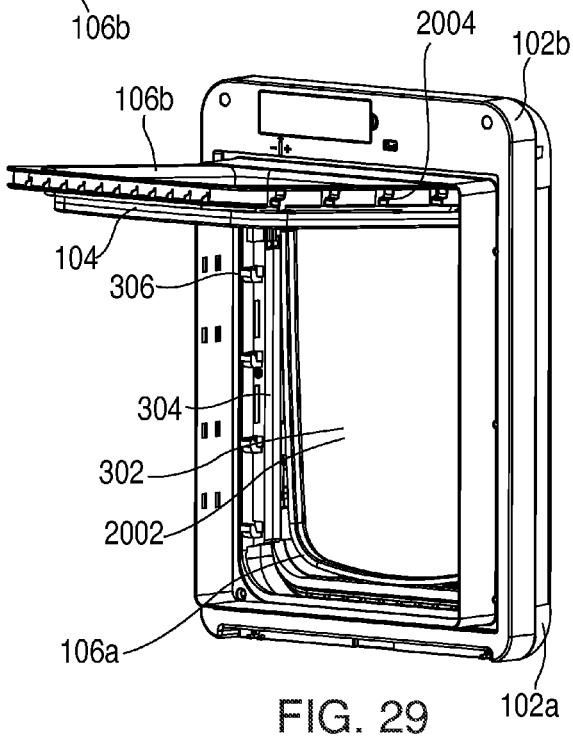
FIG. 29 is a rear perspective view of the interior frame showing the barrier flap and the outer locking flap in the outward open position.

The barrier flap 104 is moveable over a range from a fully open inward position to a fully open outward position. In various embodiments, the barrier flap 104 can rotate approximately 180° about the hinge axis. In other words, the barrier flap can rotate approximately 90° about the hinge axis in both directions starting from an initial vertical orientation (i.e., the closed position). The locking flap 106 is moveable over a range from the closed position to a fully open position. In various embodiments, the locking flap 106 can rotate approximately 90° about the hinge axis in a single direction starting from an initial vertical orientation (i.e., the closed position). In the fully open position, the barrier flap 104 and the locking flap 106 lie in a substantially horizontal orientation and extends inwardly (i.e., into the structure) or outwardly (i.e., out of the structure). FIG. 28 shows the barrier flap and the inner locking flap 106 in the fully open inward position. FIG. 29 shows the barrier flap and the outer locking flap 106 in the fully open outward position.

When unlocked, the locking flap 106 travels with the barrier flap 104. More specifically, the configurations of the barrier flap 104 and the locking flap 106 are such that when an opening force is applied to one side of the barrier flap 104, the locking flap 106 on the opposite side of the barrier flap 104 travels with the barrier flap 104. In other words, the inner locking flap 106 is pushed inwardly by the barrier flap 104 when the barrier flap 104 swings inwardly but remains in the closed position when the barrier flap 104 swings outwardly. Conversely, the outer locking flap 106 is pushed outwardly by the barrier flap 104 when the barrier flap 104 swings outwardly but remains in the closed position when the barrier flap 104 swings inwardly.

In various embodiments, locking and unlocking the lockable pet door is accomplished by changing the relative position of the locking flap 106 to the interior frame 102. In some embodiments, the locking flap 106 moves in a lateral direction between a locked position and an unlocked position. In some embodiments, the locking flap 106 moves vertically between a locked position and an unlocked position. In some embodiments, the interior frame 102 includes a hinge guide 208 that provides a closed slot in which each hinge travels when the locking flap 106 moves laterally or vertically. In other embodiments, locking and unlocking the lockable pet door is accomplished by fixing the position of locking flap 106 relative to the interior frame 102 without additional movement of the locking flap 106 or the interior frame 102.

Like the interior frame 102, the locking flap 106 includes one or more coupling members 2004 positioned to selectively engage the complimentary coupling member of the inner frame. In various embodiments, the interior frame coupling members 306 and the locking flap coupling members 2004 are fasteners brought into engagement by the movement of the locking flap 106 relative to interior frame 102 (e.g., complimentary fingers or hooks, slots and tabs). In other embodiments, the interior frame coupling members 306 and the locking flap coupling members 2004 are placed into engagement without requiring movement of the locking flap 106 relative to interior frame 102. Such fasteners include, but are not limited to, deployable stops blocking the travel path of the locking flap 106, moveable projections (e.g., a sliding bolt or pivoting hook) with complimentary receivers, and detent mechanisms. When in the locked position, the locking flap coupling members 2004 operatively engage the interior frame coupling members 306 and prevent the locking flap 106 from moving relative to the interior frame 102. In other words, the locking flap 106 is prevented from swinging toward the fully open position (i.e., opening). By preventing the locking flap 106 from opening, the barrier flap 104 is also prevented from swinging toward the fully open position in the direction of the locked locking flap 106.

In various embodiments, the locking flap 106 defines a void 2006 proximate to each locking flap coupling member 2004. When in locking flap is in the unlocked position, the voids 2006 align with and receive but do not operatively engage the interior frame coupling members 306. In various embodiments, the locking flap coupling members 2004 are aligned with but vertically offset from the interior frame coupling members 306 when in the closed position. This allows the locking flap 106 to swing away from and return to the closed position while unlocked. Further, when the locking flap moves to the locked position, the change in vertical position brings the locking flap coupling members 2004 into operative engagement with the interior frame coupling members 306.

In various embodiments, the coupling members are located at several positions around the perimeter of the locking flap 106 and the interior frame 102. By having coupling members engaged at multiple locations around the perimeter, the engagement between the locking flap 106 and the interior frame 102 is stronger and more secure (i.e., is less prone to being overcome). In some embodiments, a channel 2008 along the bottom edge of the locking flap 106 engages a shoulder 308 projecting upwardly from the sill of the interior frame 102 when in the locked position to provide a larger contact area to resist movement of the locking flap 106. In other embodiments, the bottom portion of the locking flap 106 (or a projection extending from the bottom portion) lowers into a channel defined by the sill of the interior frame 102 when in the locked position.

Figure 30:
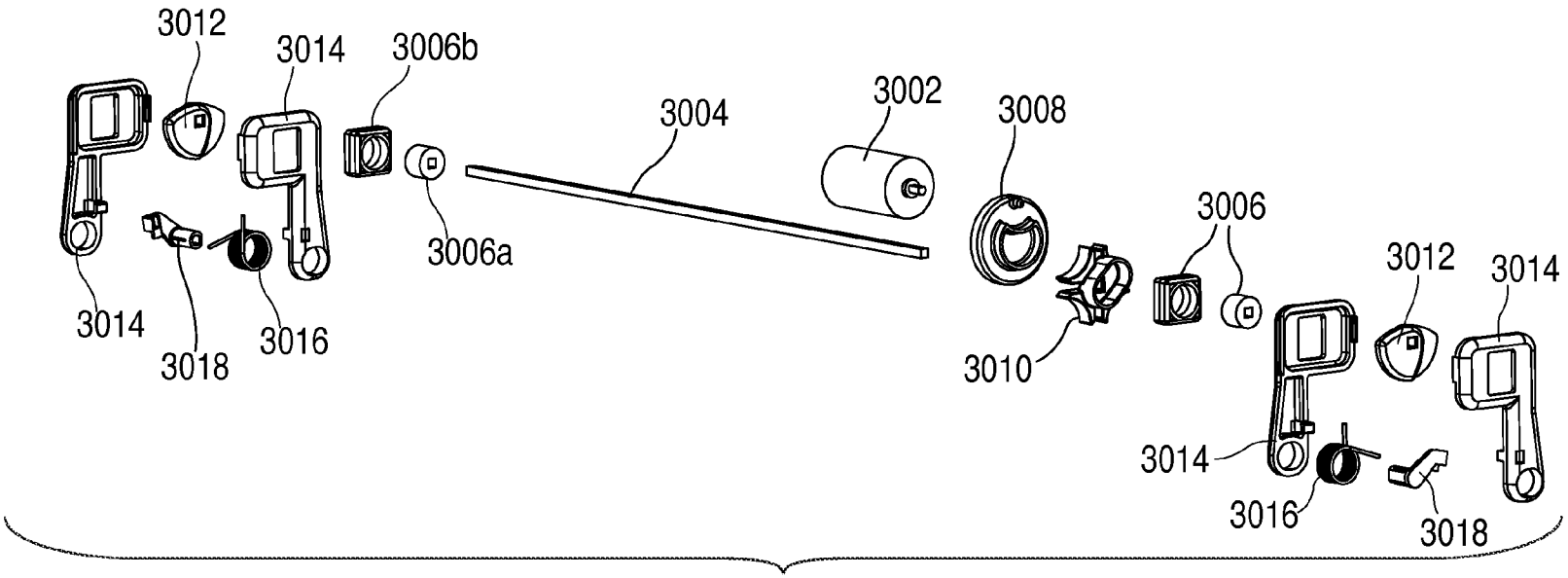
FIG. 30 is an exploded view of one embodiment of the lock mechanism.
Figure 31:
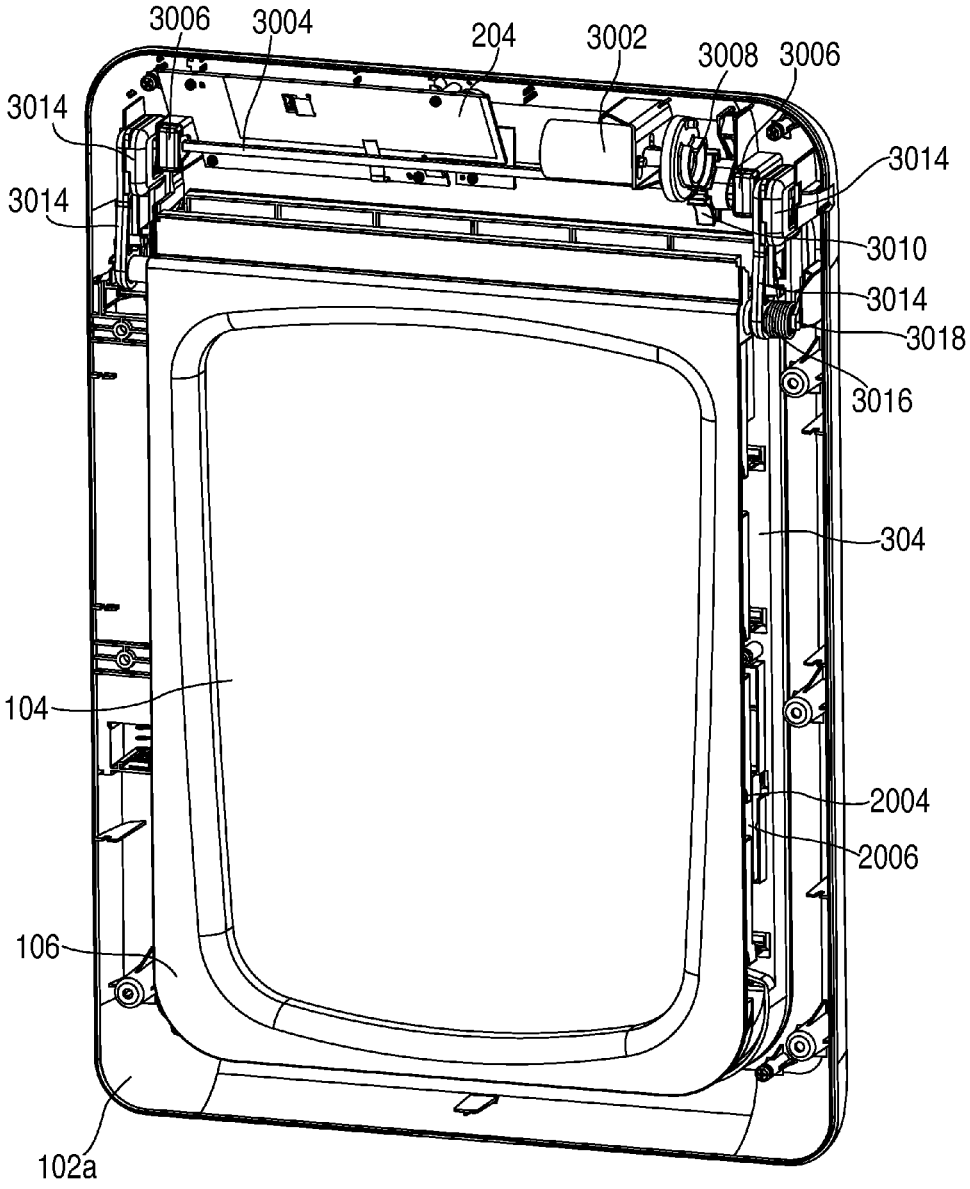
FIG. 31 is a rear perspective view of one embodiment of the interior frame with the barrier flap, the locking flaps, and the components of the lock system installed.
Figure 32:
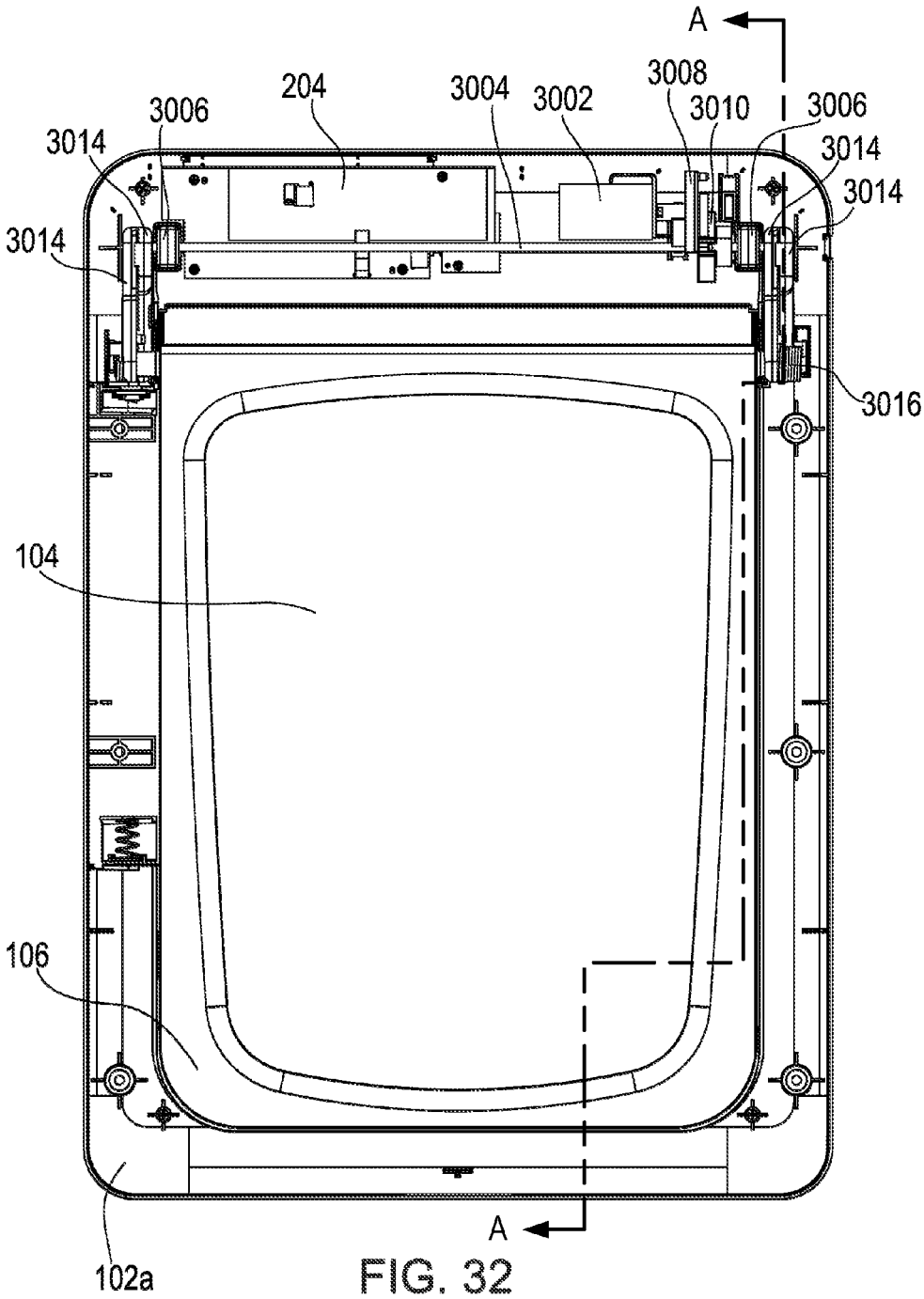
FIG. 32 is a rear elevation view of one embodiment of the interior frame with the barrier flap, the locking flaps, and the components of the lock system installed.

FIG. 30 is an exploded view of the components of the lock mechanism 202. FIGS. 31 and 32 illustrate the lock mechanism and the locking flaps 106 installed in the interior frame 102. The lock mechanism includes a drive system, an indexing system, and a positioning system. The drive system impels the movement of the locking flaps 106. The indexing system sets the number of lock states for the lock mechanism. The positioning system controls the independent movement of the locking flaps 106. In various embodiments, the lock mechanism includes four lock states: both locking flaps 106 unlocked (i.e., both ingress and egress allowed), both locking flaps 106 locked (i.e., neither ingress or egress allowed), the inner locking flap 106*a* locked and the outer locking flap 106*b* unlocked (egress allowed and ingress prohibited), and the outer locking flap 106*b* locked and the inner locking flap 106*a* unlocked (ingress allowed and egress prohibited). In other embodiments, the lock mechanism includes fewer (or more, if available) than four lock states.

In various embodiments, the drive system is an electromechanical system including at least a motor 3002 (e.g., a geared dc motor). The motor 3002 and the drive shaft 3004 are mounted in the interior frame 102. In various embodiments, the drive shaft 3004 is supported by two roller bearing assemblies 3006 that allow the drive shaft 3004 to rotate while keeping its location fixed. Each roller bearing assembly 3006 includes a roller bearing 3006*a* which is housed in roller bearing race 3006*b*. In other embodiments, the drive system is a mechanical system where the motor 3002 is replaced by a manual drive mechanism (e.g., a knob or lever).

The indexing system indexes the rotation of a drive shaft 3004 to implement the desired number of lock states. In various embodiments, the indexing system is a mechanical system connecting the motor 3002 and the drive shaft 3004. One example of a suitable mechanical indexing system is the Geneva drive of the illustrated embodiment. The Geneva drive includes a Geneva drive wheel 3008 and a Geneva follower 3010. The Geneva drive wheel 3008 is operatively connected to the motor 3002 and the Geneva follower 3010. The Geneva follower 3010 is operatively connected to the drive shaft 3004. As the motor 3002 drives the Geneva drive wheel 3008, the Geneva follower 3010 turns at a reduced rate based on the number of slots. To provide the four lock states described above, the Geneva follower 3010 defines four orthogonally arranged slots, each corresponding to one of the four lock states of the lock mechanism. As the motor 3002 drives the Geneva drive wheel 3008 through one complete rotation, the Geneva follower 3010, and therefore the drive shaft 3004, completes one quarter rotation. In various embodiments, another type of indexing system is used to index the drive shaft 3004 including, but not limited to, a stepper motor, a servomotor, or a mechanical linkage.

The operation of the Geneva drive indexing system is explained through the illustrations in FIGS. 37A through 37G. The convex portion 3702 of the arc on the Geneva drive wheel 3008 engages a concave arc 3704 on the Geneva follower 3010 normally preventing rotation of the Geneva follower 3010 and the drive shaft 3004. As the Geneva drive wheel 3008 turns, the concave portion 3706 of the arc on the Geneva drive wheel 3008 rotates into alignment with the Geneva follower 3010 and the pin 3708 engages one of the channels 3710 in the Geneva follower 3010 causing it to turn the drive shaft 3004. Subsequently, the convex portion of the arc on the Geneva drive wheel 3008 re-engages a concave arc of the Geneva follower 3010 and ends rotation of the Geneva follower 3010 and the drive shaft 3004.

The drive shaft 3004 is connected to the positioning system. The locking flaps 106 are moved between the locked and unlocked positions by the positioning system. In the illustrated embodiment, the positioning system includes two dual cams 3012 and corresponding cam followers 3014. Each dual cam 3012 is associated with one of the locking flaps 106. In various embodiments, each dual cam is a single part with two identical cams that are 90° out of phase with respect to each other. In other embodiments, separate cams configured similarly to the dual cams are used. The dual cams are mounted on the drive shaft 3004 and connected to the cam followers. Each locking flap 106 is connected to a pair of the cam followers. As the drive shaft 3004 moves between the indexed positions, the cams raise and lower the cam followers. In turn, the followers raise and lower the locking flaps 106. Each locking flap 106 is lowered into the locked position and raised into the unlocked position.

The lockable pet door includes one or more closure mechanisms to hold in the locking flaps 106 and/or the barrier flap 104 the closed position when locking the lockable pet door. The closure mechanism operates to draw the barrier flap 104 and/or the locking flaps 106 to the closed position and reduce the time required for the barrier flap 104 and/or the locking flaps 106 to settle in the closed position. Additionally, the closure mechanism provides a minimal threshold force that must be overcome to move the barrier flap 104 and/or the locking flaps 106 out of the closed position (e.g., to resist movement of the barrier flap by the wind and prevent jamming of the lock system due to displacement of the locking flaps). In various embodiments, the lockable pet door includes a rotary damper on the hinge of the barrier flap to prevent the barrier flap 104 and/or the locking flap 106 from slamming shut.

In some embodiments, the closure mechanism includes at least one torsion spring 3016 that is connected between the cam follower and the torsion spring arm 3018. The torsion spring 3016 provides assistance in overcoming friction and the force of the locking flap 106 limit switches. The torsion spring is preloaded between the follower and torsion spring arm thus imparting a torque on the torsion spring arm which in turns imparts a torque on the hinge of the locking flap 106 to bias the locking flap 106 to the closed position. The threshold force is determined by the strength of the torsion spring.

In some embodiments, the closure mechanism includes one or more magnets 210 carried by the interior frame 102 and one or more magnets 1902 carried by the barrier flap 104. In some embodiments, one or more magnets 212 are carried by the locking flaps 106. In other embodiments, the magnetic closure includes at least one magnet pair with a magnetic (e.g., ferromagnetic) material. The magnets and/or the magnetic material are located in selected locations of the interior frame 102, the barrier flap 104, and the locking flaps 106 facilitating magnetic attraction when the barrier flap 104 and/or the locking flaps 106 approach the closed position. The magnetic closure also helps to hold the barrier flap 104 and the locking flap 106 moving with the barrier flap together. The threshold force is determined by the strength and/or number of the magnets used.

To improve reliability, a position sensing system is used to sense the positions of the locking flaps 106 and the indexing system components. In various embodiments, the position sensing system includes four limit switches for sensing position of the locking flaps 106 and the Geneva indexer. The limit switches are in communication with the controller in the control circuitry 204 of the lockable pet door. The controller uses the information from the limit switches before activating the motor to move the locking flaps into the locked position and control the operation of the motor to move between the available lock states. The Geneva drive wheel limit switch 214 detects when the Geneva drive wheel 30 has completed one revolution (i.e., one 90° index of the drive shaft 3004). The Geneva wheel follower switch 216 is a normally open switch that is depressed when both locking flaps 106 are locked. The Geneva wheel follower switch is used for software calibration in the event of power loss or software malfunction to return the lockable pet door to a known lock state. The inner locking flap switch 218*a* and the outer locking flap switch 218*b* are normally open switches that are depressed when the corresponding locking flap is closed. The locking flap switches are used to verify that the locking flap is closed before locking the lockable pet door to prevent jamming due to misalignment or failure to lock due to non-alignment of the coupling members 306, 2004.

Figure 33:
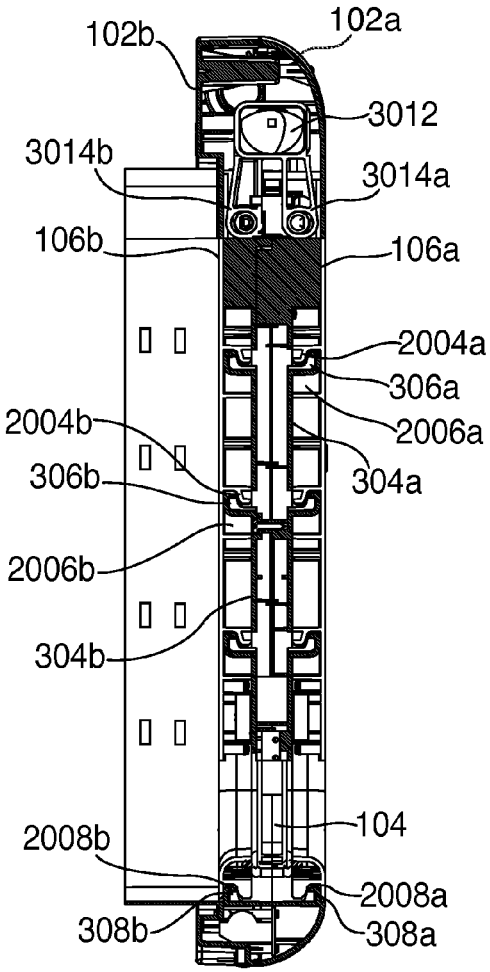
FIG. 33 is a section view of the interior frame showing the inner locking flap and the outer locking flap in the locked position taken along cut line A-A in FIGS. 13 and 32.

FIG. 33 illustrates the lockable pet door with the inner locking flap and the outer locking flap lowered into the locked position corresponding to a first lock state preventing both ingress and egress through the lockable pet door 100. In the locked position, the dual cam 3012 pushes (or allows gravity to pull) the inner locking flap cam follower 3014*a* and the outer locking flap cam follower 3014*b* downward. When pushed down, the inner locking flap coupling members 2004*a* engage the frame coupling members 306*a* and the inner locking flap channel 2008*a* engages the front part shoulder 308*a* to secure the inner locking flap 106*a* to the interior frame 102 and prevent the inner locking flap 106*a* from being able to swing. Likewise, the outer flap coupling members 2004*b* engage the frame coupling members 306*b* and the outer locking flap channel 2008*b* engages the rear part shoulder 308*b* to secure the outer locking flap 106*b* to the interior frame 102 and prevent the outer locking flap 106*b* from being able to swing. The barrier flap 104 is captured between the locked inner locking flap 106*a* and the locked outer locking flap 106*b* preventing the barrier flap 104 from being opened in either direction and preventing both ingress and egress through the lockable pet door 100.

Figure 34:
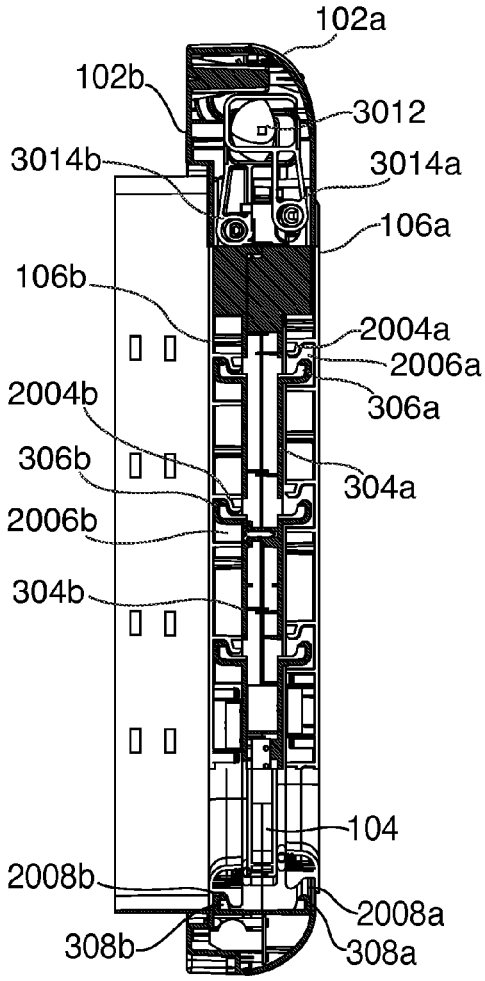
FIG. 34 is a section view of the interior frame showing the inner locking flap in the unlocked position and the outer locking flap in the locked position taken along cut line A-A in FIGS. 13 and 32.

FIG. 34 illustrates the lockable pet door with the inner locking flap 106*a* raised to the unlocked position and the outer locking flap 106*b* lowered into the locked position corresponding to a second lock state allowing ingress while preventing egress through the lockable pet door. In this lock state, the dual cam 3012 pushes the inner locking flap cam follower 3014*a* upwards to while simultaneously pushing (or allowing gravity to pull) the outer locking flap cam follower 3014*b* downward. When raised, the inner locking flap coupling members 2004*a* disengage from the frame coupling members 306*a* and the inner locking flap channel 2008*a* disengages the front part shoulder 308*a* to release the inner locking flap 106*a* from the interior frame 102 and allow the inner locking flap 106*a* to swing. In the closed but unlocked position, the frame coupling members 306*a* rest within the voids 2006*a* and remain vertically aligned with but offset from the inner locking flap coupling members 2004*a*. The barrier flap 104 is only restricted in one direction by the locked outer locking flap 106*b* and can swing inwardly to allow ingress.

Figure 35:
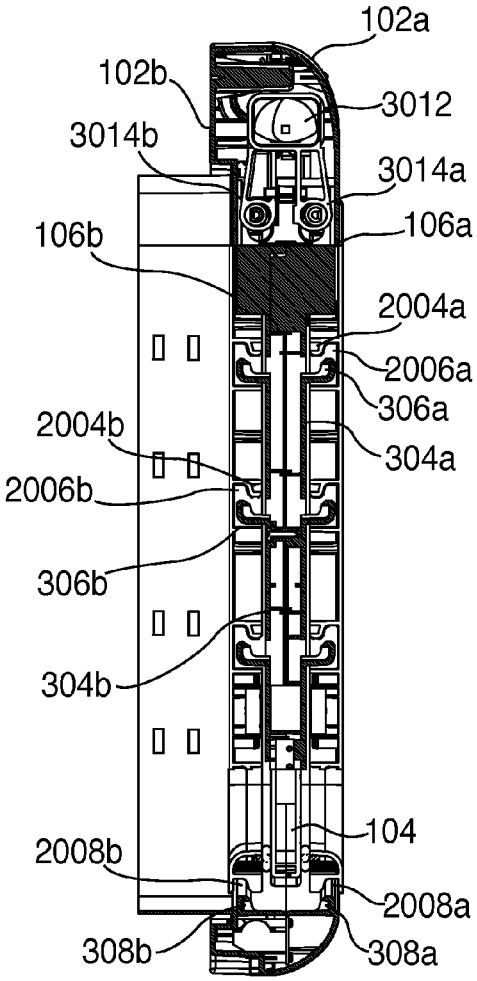
FIG. 35 is a section view of the interior frame showing the inner locking flap and the outer locking flap in the unlocked position taken along cut line A-A in FIGS. 13 and 32.

FIG. 35 illustrates the lockable pet door with the inner locking flap 106*a* and the outer locking flap 106*b* raised to the unlocked position corresponding to a third lock state allowing both ingress and egress through the lockable pet door. Movement of the barrier flap 104 is not restricted by either the inner locking flap 106*a* or the outer locking flap 106*b* and can swing both inwardly and outwardly to allow ingress and egress.

Figure 36:
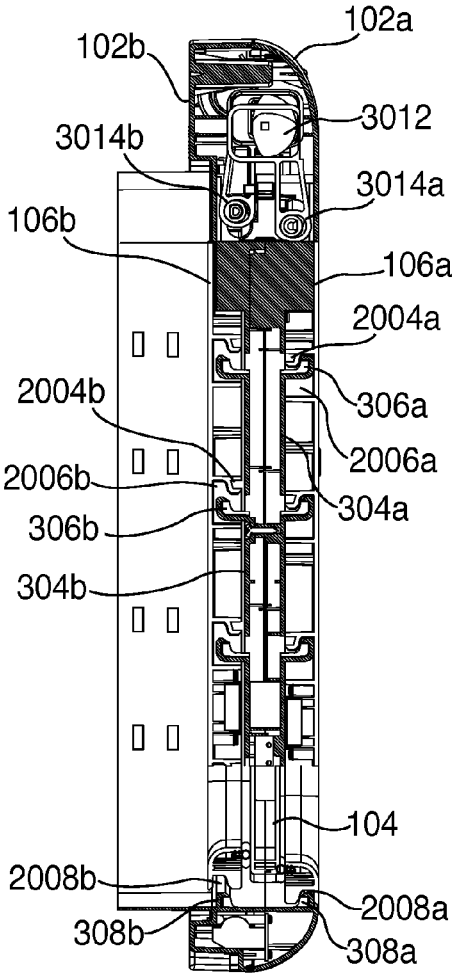
FIG. 36 is a section view of the interior frame showing the inner locking flap in the locked position and the outer locking flap in the unlocked position taken along cut line A-A in FIGS. 13 and 32.
Figure 37A:
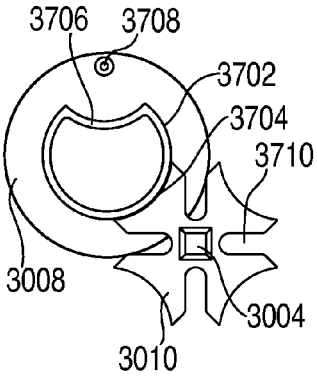
FIGS. 37A-37G illustrate the operation of the Geneva drive used in one embodiment of the indexing system of the lockable pet door.
Figure 37B:
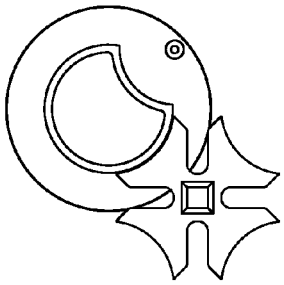
Figure 37C:
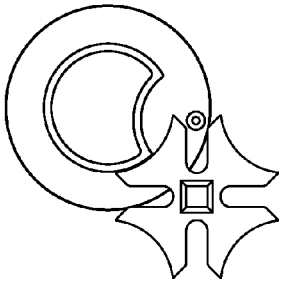
Figure 37D:
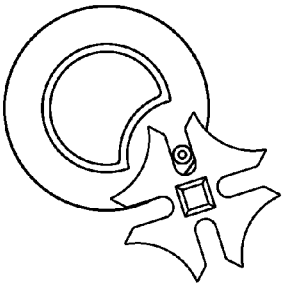
Figure 37E:
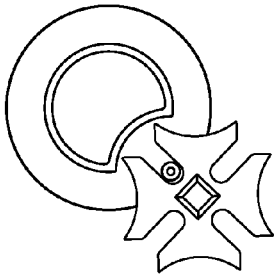
Figure 37F:
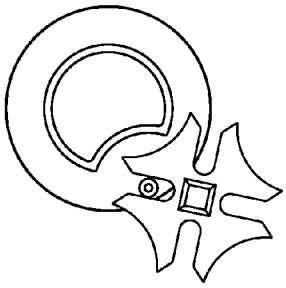
Figure 37G:
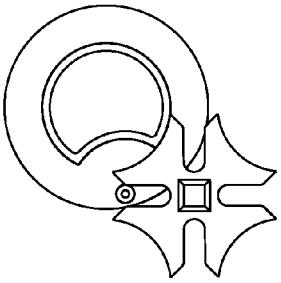

FIG. 36 illustrates the lockable pet door with the inner locking flap 106*a* lowered into the locked position and the outer locking flap 106*b* raised to the unlocked position corresponding to a fourth lock state allowing egress while preventing ingress through the lockable pet door. The barrier flap 104 is only restricted in one direction by the locked inner locking flap 106*a* and can swing outwardly to allow egress.

The operation of the lockable pet door and the arrangement of parts have been described in the context of flaps mounted at the top of the passageway and swinging about a horizontal axis. This commonly used arrangement takes advantage of gravity to return the flaps to the normally closed position. In other embodiments, the flaps are mounted at either side of the passageway and swing about a vertical axis.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. A lockable pet door comprising:

a frame defining a primary opening;

a barrier flap operatively connected to said frame, said barrier flap swinging inwardly and outwardly to allow passage through said primary opening;

an inward locking flap operatively connected to said frame inwardly of said barrier flap, said inward locking flap defining a secondary opening aligned with said primary opening when said inward locking flap is closed, said inward locking flap being free to swing inwardly when said barrier flap swings inwardly and said inward locking flap is unlocked, said inward locking flap being prevented from moving relative to said frame and preventing said barrier flap from swinging inwardly while said inward locking flap is locked; and a lock operatively connected to said inward locking flap, said lock selectively locking and unlocking said inward locking flap.

2. The lockable pet door of claim 1 characterized in that:

said frame includes a first inward coupling member; and said inward locking flap includes a second inward coupling member adapted to engage said first inward coupling member when said inward locking flap is locked and to disengage from said first inward coupling member when said inward locking flap is unlocked.

3. The lockable pet door of claim 2 characterized in that said frame includes a plurality of first inward coupling members and said inward locking flap includes a plurality of a second inward coupling members.

4. The lockable pet door of claim 1 further comprising an outward locking flap operatively connected to said frame outwardly of said barrier flap, said outward locking flap defining a secondary opening aligned with said primary opening when said outward locking flap is closed, said outward locking flap being free to swing outwardly when barrier flap swings outwardly and said outward locking flap is unlocked, said outward locking flap being prevented from moving relative to said frame and preventing said barrier flap from swinging outwardly while said outward locking flap is locked, and said outward locking flap being operatively connected to said lock.

5. The lockable pet door of claim 4 characterized in that:

said frame includes a first inward coupling member and a first outward coupling member;

said inward locking flap includes a second inward coupling member adapted to engage said first inward coupling member when said inward locking flap is locked and to disengage from said first inward coupling member when said inward locking flap is unlocked; and said outward locking flap includes a second outward coupling member adapted to engage said first outward coupling member when said outward locking flap is locked and to disengage from said first outward coupling member when said outward locking flap is unlocked.

6. The lockable pet door of claim 5 characterized in that said frame includes a plurality of first inward coupling members and said inward locking flap and said outward locking flap each include a plurality of second inward coupling members.

7. The lockable pet door of claim 4 characterized in that said inward locking flap remains closed when said barrier flap swings outwardly and said outward locking flap remains closed when said barrier flap swings inwardly.

8. The lockable pet door of claim 4 characterized in that said barrier flap is larger than said inward and outward locking flap secondary openings thereby preventing said barrier flap from passing through said inward and outward locking flap secondary openings.

9. The lockable pet door of claim 4 characterized in that said inward locking flap is moveable between a locked position and an unlocked position and said outward locking flap is moveable between a locked position and an unlocked position.

10. The lockable pet door of claim 9 characterized in that said lock independently moves said inward locking flap between said locked and unlocked positions and said outward locking flap between said locked and unlocked positions.

11. A lockable pet portal comprising:

a frame defining a passageway having a first end and a second end, said frame having a first coupling member;

a central flap pivotally attached to said frame, said central flap having a first side facing said passageway first end and a second side facing said passageway second end, said central flap blocking passage through said passageway when closed, said central flap adapted to swing open and allow passage through said passageway;

a first locking flap pivotally attached to said frame and situated on said first side of said central flap, said first locking flap being lockable to said frame while in a closed orientation, said first locking flap swinging open with said central flap when said central flap is pushed open from said second side and said first locking flap is unlocked, said first locking flap preventing said central flap from swinging open when said central flap is pushed from said second side while said first locking flap is locked, said first locking flap defining a through opening allowing said central flap to be pushed open from said first side while said first locking flap remains in said closed orientation; and a second locking flap pivotally attached to said frame and situated on said second side of said central flap, said second locking flap being lockable to said frame while in a closed orientation, said second locking flap swinging open with said central flap when said central flap is pushed open from said first side and said second locking flap is unlocked, said first locking flap preventing said central flap from swinging open when said central flap is pushed from said second side while said first locking flap is locked, said second locking flap defining a through opening allowing said central flap to be pushed open from said second side while said second locking flap remains in said closed orientation; and a lock mechanism selectively locking and unlocking said first locking flap and said second locking flap.

12. The lockable pet door of claim 11 characterized in that:

said first locking flap operatively engages said frame at a plurality of locations around the perimeter of said passageway first end to lock said first locking flap in said closed orientation; and said second locking flap operatively engages said frame at a plurality of locations around the perimeter of said passageway second end to lock said second locking flap in said closed orientation.

13. The lockable pet door of claim 12 further comprising:

a plurality of first coupling members on said frame;

a plurality of first locking members on said first locking flap operatively engaging said first coupling members when said first locking flap is locked;

a plurality of second coupling members on said frame; and a plurality of second locking members on said second locking flap operatively engaging said second coupling members when said second locking flap is locked.

14. The lockable pet door of claim 13 further comprising a closure drawing said first locking flap to a substantially vertical orientation placing said plurality of first coupling members in vertical alignment with said plurality of first locking members for proper engagement when said first locking flap is moved to the locked position and said second locking flap to a substantially vertical orientation placing said plurality of second coupling members in vertical alignment with said plurality of second locking members for proper engagement when said second locking flap is moved to the locked position.

15. The lockable pet door of claim 13 further comprising a first magnetic component in said frame and a second magnetic component in said first locking flap, said first magnetic component and said second magnetic component cooperating to draw said first locking to a position placing said plurality of first coupling members in vertical alignment with said plurality of first locking members for proper engagement when said first locking flap is moved to the locked position, at least one of said first magnetic component and said second magnetic component being a magnet.

16. The lockable pet door of claim 13 further comprising a sensor for determining that said first locking flap is in a position placing said plurality of first coupling members in vertical alignment with said plurality of first locking members for proper engagement.

17. The lockable pet door of claim 11 characterized in that said lock mechanism comprises a drive mechanism operatively connected to said first locking flap to impel movement of said first locking flap between a locked position and an unlocked position while said first locking flap is in a closed position, said drive mechanism operatively connected to said locking flap to impel movement of said second locking flap between a locked position and an unlocked position while said second locking flap is in a closed position, said first locking flap moveable between said locked position and said unlocked position independently from said second locking flap.

18. The lockable pet door of claim 17 characterized in that said lock mechanism further comprises an indexing mechanism operatively connecting said drive mechanism to said first locking flap and said second locking flap, said indexing mechanism having:

a first state with said first locking flap in said locked position and moving said second locking flap into said locked position to prevent both travel in both directions through said passageway;

a second state moving said first locking flap into said unlocked position while leaving said second locking flap in said locked position to allow travel in one direction through said passageway;

a third state leaving said first locking flap in said unlocked position while moving said second locking flap into said unlocked position to allow travel in both directions through said passageway; and a fourth state moving said first locking flap into said locked position while leaving said second locking flap in said unlocked position to allow travel in the opposite direction through said passageway.

19. The lockable pet door of claim 11 characterized in that said lock mechanism comprises:

a motor;

a drive shaft;

a cam operatively connected to said drive shaft, said cam operatively connected to said first locking flap and to said second locking flap, said cam having a first orientation placing both said first locking flap and said second locking flap in a locked position, said cam having a second orientation placing said first locking flap in an locked position and said second locking flap in an unlocked position, said cam having a third orientation placing both said first locking flap and said second locking flap in a unlocked position, said cam having a fourth orientation placing said second locking flap in an unlocked position and said second locking flap in an locked position;

an indexing mechanism operatively linking said motor to said cam, said indexing mechanism moving said cam to a successive one of said four positions when driven by said motor.

20. A lockable pet door for allowing passage through a structural feature having an interior side and an exterior side, said lockable pet door comprising:

a frame defining a passageway allowing passage between the interior side and the exterior side of the structural feature, said frame defining a first coupling member and a second coupling member;

a barrier flap mounted within said passageway, said barrier flap adapted to swing between a first open position on the interior side of the structural feature and a second open position on the exterior side of the structural feature, said barrier flap resting in a closed position blocking passage though said passageway;

an inner locking flap mounted within said passageway on the interior side of said barrier flap, said inner locking flap defining a first through opening smaller than said barrier flap such that said barrier flap cannot pass through said first through opening, said inner locking flap comprising a first securing member adapted to selectively engage said first coupling member, said inner locking flap moveable between a locked position with said first securing member operatively engaging said first coupling member, an unlocked position with said first securing member operatively disengaged from said first coupling member, and an open position on said interior side of said frame;

an outer locking flap mounted within said passageway on the exterior side of said barrier flap, said outer locking flap defining a second through opening smaller than said barrier flap such that said barrier flap cannot pass through said second through opening, said outer locking flap comprising a second securing member adapted to selectively engage said second coupling member, said outer locking flap moveable between a locked position with said second securing member operatively engaging said second coupling member, an unlocked position with said second securing member operatively disengaged from said second coupling member, and an open position on said exterior side of said frame; and a lock selectively moving said inner locking flap between said locked position and said unlocked position and selectively moving said outer locking flap between said locked position and said unlocked position.

* * * * *